US009026314B2

(12) United States Patent
Kigoshi et al.

(10) Patent No.: US 9,026,314 B2
(45) Date of Patent: May 5, 2015

(54) OPENING/CLOSING BODY CONTROL DEVICE

(71) Applicants: Katsunori Kigoshi, Aichi (JP); Kenji Sato, Aichi (JP)

(72) Inventors: Katsunori Kigoshi, Aichi (JP); Kenji Sato, Aichi (JP)

(73) Assignee: Omron Automotive Electronics Co., Ltd., Aichi (JP)

( * ) Notice: Subject to any disclaimer, the term of this patent is extended or adjusted under 35 U.S.C. 154(b) by 0 days.

(21) Appl. No.: 14/158,912

(22) Filed: Jan. 20, 2014

(65) Prior Publication Data

US 2014/0207343 A1 Jul. 24, 2014

(30) Foreign Application Priority Data

Jan. 21, 2013 (JP) ..... 2013-008471

(51) Int. Cl.

| | |
|---|---|
| ***B60R 22/00*** | (2006.01) |
| ***E05F 15/00*** | (2006.01) |
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.

CPC ..... *E05F 15/40* (2015.01); *E05Y 2900/55* (2013.01); *E05Y 2900/50* (2013.01); *E05F 15/41* (2015.01); *E05F 15/695* (2015.01); *E05F 15/77* (2015.01)

(58) Field of Classification Search

CPC ..... E05Y 2900/50; E05Y 2900/00; E05Y 2900/55; E05F 15/2076; E05F 1/00; E05F 15/40; E05F 15/41; E05F 15/695; E05F 15/77

USPC ..... 701/49

See application file for complete search history.

(56) References Cited

U.S. PATENT DOCUMENTS

| | | | | |
|---|---|---|---|---|
| 3,733,532 | A * | 5/1973 | Hill | 318/266 |
| 7,570,001 | B2 | 8/2009 | Noro et al. | |
| 7,619,381 | B2 | 11/2009 | Kawai et al. | |
| 2002/0047678 | A1 * | 4/2002 | Wilson | 318/445 |
| 2004/0119433 | A1 | 6/2004 | Tanoi et al. | |
| 2007/0120538 | A1 * | 5/2007 | Sato | 322/45 |
| 2011/0154738 | A1 * | 6/2011 | Suzuki | 49/28 |

FOREIGN PATENT DOCUMENTS

| | | | |
|---|---|---|---|
| JP | H07-139259 | A | 5/1995 |
| JP | H07-158345 | A | 6/1995 |
| JP | 2004-143732 | A | 5/2004 |
| JP | 2007-191947 | A | 8/2007 |
| JP | 2008-038352 | A | 2/2008 |

* cited by examiner

*Primary Examiner* — Mary Cheung
*Assistant Examiner* — Frederick Brushaber
(74) *Attorney, Agent, or Firm* — Osha Liang LLP

(57) ABSTRACT

An opening/closing body control device has a controller that controls a driving operation of a motor for carrying out an operation for opening/closing an opening/closing body of a vehicle, a load detector that detects a load of the motor; a deciding part that compares a variation in the load detected by the load detector with a predetermined threshold, thereby deciding presence of insertion of a foreign substance into the opening/closing body during the operation for closing the opening/closing body, an engine state detector that detects a stopping state of an engine of the vehicle, a receiver that receives a closing command for the opening/closing body which is transmitted from a remote control machine, and a changing part that changes the threshold.

20 Claims, 4 Drawing Sheets

OPENING/CLOSING BODY CONTROL DEVICE

BACKGROUND OF THE INVENTION

1. Technical Field

The present invention relates to an opening/closing body control device for opening/closing an opening/closing body of a vehicle by remote control, thereby detecting insertion of a foreign substance in an operation for closing the opening/closing body.

2. Related Art

For example, an opening/closing body control device to be provided on a vehicle includes a power window device. The power window device rotates a motor normally or reversely to carry out an operation for opening/closing a window glass of a window to be an opening/closing body.

For example, Japanese Unexamined Patent Publications Nos. 7-158345, 7-139259, 2004-143732, 2007-191947 and 2008-38352 disclose the technique for detecting insertion of a foreign substance into a window in an operation for closing a window glass in a power window device. More specifically, a load of a motor is detected based on a rotating speed of a motor or current flowing to the motor, and presence of the insertion is decided based on a result obtained by comparing a variation in the load with a predetermined threshold. If it is decided that the insertion is present, the motor is controlled to stop the window glass or to carry out an opening operation after the stoppage.

In the Japanese Unexamined Patent Publication No. 7-158345, an operation for opening/closing a window glass is controlled upon receipt of a command sent from a remote control machine carried by a user in addition to an operation of a switch provided on a vehicle. In order to prevent a malfunction from being caused by a slight change in the load, moreover, it is decided that a man exists and an insertion threshold is thus changed into a gentle value while an ignition key is on, while a closing signal is sent from the remote control machine or while a lock signal is sent from a door lock device. On the other hand, while the ignition key is off, it is decided that the man does not exist and the insertion threshold is changed into a sensitive value.

The insertion is detected to stop the operation for closing a window glass or to carry out the opening operation after the stoppage. Thus, the window is maintained to be opened, which is not good in crime prevention or indoor environment. In the Japanese Unexamined Patent Publication No. 7-139259, when the insertion is detected, an insertion deciding threshold is increased to prepare for a next switch closing operation in order to completely close the window. Moreover, the number of times of the insertion detection is counted to control the increase in the threshold to reach a maximum value.

In the Japanese Unexamined Patent Publication No. 2004-143732, when an operation for closing a window glass is stopped or an opening operation after the stoppage is repeated even if an operation for closing a switch is carried out, an insertion deciding threshold is changed from an initial first decision value to a second decision value which is greater than the first decision value after the closing operation of the switch is carried out a predetermined number of times. Moreover, the insertion deciding threshold is changed into the second decision value and is then returned to the first decision value after a predetermined time passes.

In the Japanese Unexamined Patent Publication No. 2007-191947, the insertion is detected to carry out an operation for opening a window glass, and an operation for closing the window glass is performed with priority depending on a closing operation of a switch by a crew until a predetermined condition is satisfied.

On the other hand, in the Japanese Unexamined Patent Publication No. 2008-38352, in the case in which an operation for forcibly closing a switch is maintained even if insertion is detected, an operation for closing a window glass is continuously carried out. When the forced closing operation of the switch is cancelled in the middle of the operation for closing the window glass, moreover, an operation for opening a window is carried out in such a manner that an opening quantity of the window glass is reduced to be smaller than usual.

In the case in which an operation for closing a window is carried out by a remote control machine to perform an operation for closing a window glass, an operator does not always see the window. Moreover, there is a possibility that the operation for closing the window glass might be carried out in a place where a vehicle cannot be seen. For this reason, there is a fear that the operator might continuously carry out the closing operation by the remote control machine without noticing that a foreign substance enters a clearance of the window. Therefore, there is a high possibility that the foreign substance might be inserted into the window. In this case, if a threshold of the insertion is set to be a gentle value, detection precision in the insertion is reduced. For this reason, the insertion cannot be detected quickly.

On the other hand, if the threshold of the insertion is set to be a sensitive value, smaller force than usual acts on a motor. Consequently, it is decided that the insertion is present and the window glass is stopped or the opening operation is carried out after the stoppage. At this time, the operator is convinced that he/she has closed the window by remote control. For this reason, there is a high possibility that the operation for closing the window is not carried out again but the window might be left in an opening state.

SUMMARY

One or more embodiments of the present invention enhances detection precision in insertion of a foreign substance into an opening/closing body and to prevent the opening/closing body from being left in an opening state in the case in which an operation for closing the opening/closing body is carried out by remote control.

An opening/closing body control device according to one or more embodiments of the present invention includes a controller for controlling a driving operation of a motor for carrying out an operation for opening/closing an opening/closing body of a vehicle, a load detector for detecting a load of the motor, a deciding part for comparing a variation in the load detected by the load detector with a predetermined threshold, thereby deciding presence of insertion of a foreign substance into the opening/closing body during the operation for closing the opening/closing body, an engine state detector for detecting a stopping state of an engine of the vehicle, a receiver for receiving a closing command for the opening/closing body which is transmitted from a remote control machine, and a changing part for changing the threshold. When the stopping state of the engine is detected by the engine state detector and the closing command is received by the receiver, the changing part changes the threshold from a normal value to a sensitive value for detecting the insertion more sensitivity than the normal value, the controller controls the motor to carry out the operation for closing the opening/closing body. The controller controls the motor and stops the opening/closing body or carries out the opening operation after the stoppage if the deciding part decides that the insertion is present during the operation for closing the opening/closing body. When a predetermined time then passes, the controller automatically controls the motor to carry out the operation for closing the opening/closing body.

According to the foregoing, in the case in which the operation for closing the opening/closing body is carried out by remote control in a state in which the engine of the vehicle is stopped, an insertion deciding threshold is changed from the normal value to the sensitive value. For this reason, even if a foreign substance is inserted into the opening/closing body, the insertion can be detected quickly to enhance detection precision in the insertion by comparison between the variation in the load of the motor and the sensitive value. In the case in which the insertion is detected to stop the opening/closing body or to carry out the opening operation after the stoppage, moreover, the operation for automatically closing the opening/closing body is performed after the predetermined time passes. For this reason, the opening/closing body can be prevented from being left in an opening state even if a user does not notice that.

According to one or more embodiments of the present invention, in the opening/closing body control device, while the controller automatically controls the motor to carry out the operation for closing the opening/closing body, the deciding part may decide the presence of the insertion.

According to one or more embodiments of the present invention, in the opening/closing body control device, when the controller automatically controls the motor to carry out the operation for closing the opening/closing body, the changing part may change the threshold to a gentler value than the sensitive value.

According to one or more embodiments of the present invention, in the opening/closing body control device, the controller may automatically control the motor to restrict, to a predetermined number of times, a number of times that the operation for closing the opening/closing body is carried out.

According to one or more embodiments of the present invention, in the opening/closing body control device, the changing part may change the threshold to become stepwise gentler every time the controller automatically controls the motor to carry out the operation for closing the opening/closing body. In this case, the changing part may change the threshold from the sensitive value to the normal value so as to become stepwise gentler.

According to one or more embodiments of the present invention, in the opening/closing body control device, a door state detector for detecting an opening/closing state of a door of a vehicle may further be provided, and the changing part may change the threshold from the normal value to the sensitive value and the controller may control the motor to carry out the operation for closing the opening/closing body when the stopping state of the engine is detected by the engine state detector and the closing command for the opening/closing body is received by the receiver, and the closing states of all of the doors are detected by the door state detector.

According to one or more embodiments of the present invention, in the opening/closing body control device, the opening/closing body may be configured by a window to be a power window provided on the door and a window glass, an operating part may further be provided in the vehicle, and the controller may drive the motor to carry out an operation for opening/closing the window glass depending on a command sent from the remote control machine or an operation state of the operating part.

According to one or more embodiments of the present invention, in the opening/closing body control device, it is possible to enhance detection precision in insertion of a foreign substance into an opening/closing body and to prevent the opening/closing body from being left in an opening state in the case in which the opening/closing body is caused to perform a closing operation by remote control.

DETAILED DESCRIPTION

Figure 1:
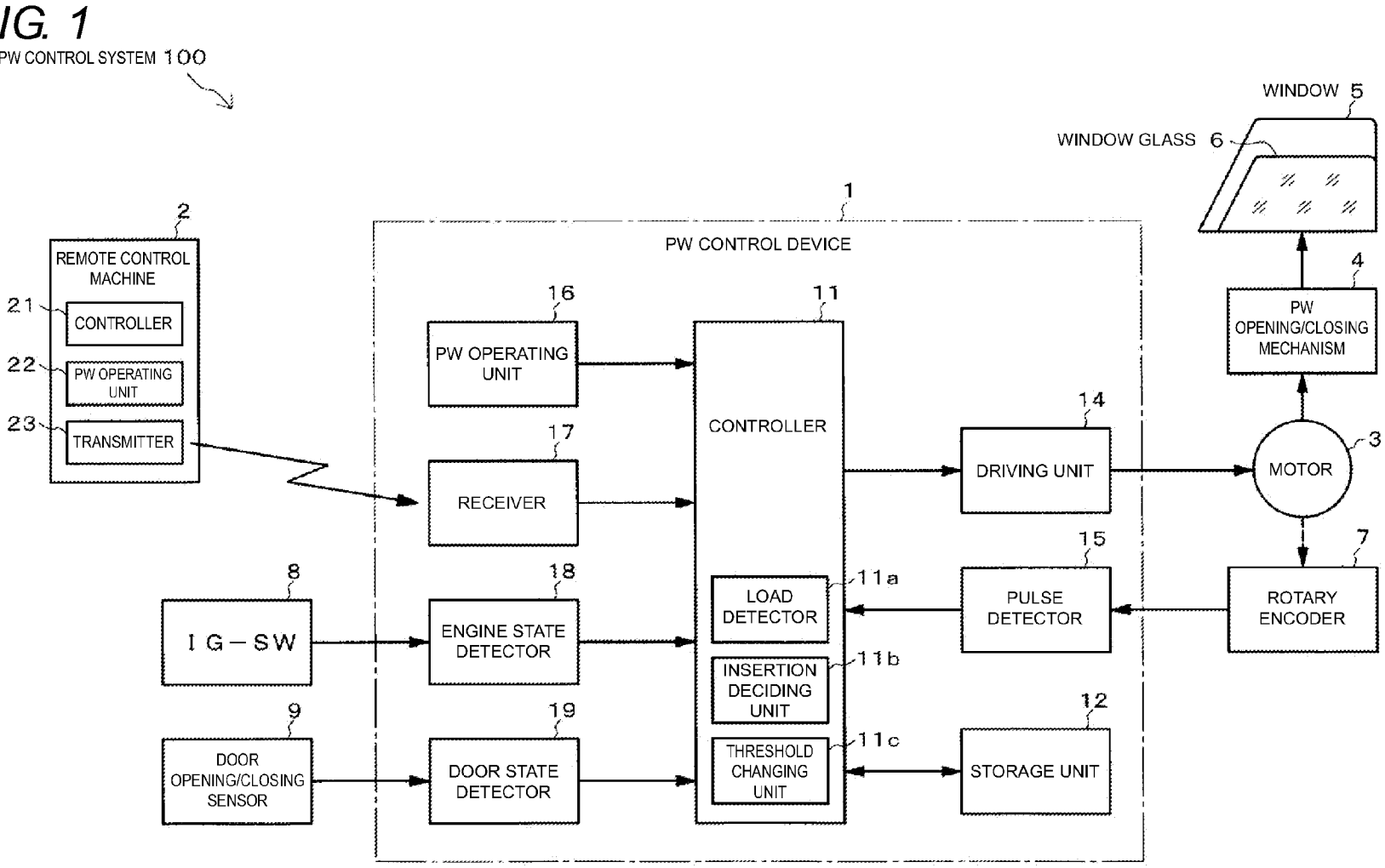
FIG. 1 is a diagram showing a structure of a power window control device according to one or more embodiments of the present invention.

Embodiments of to the present invention will be described below with reference to the drawings. In each of the drawings, the same or corresponding portions have the same reference numerals. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First of all, a structure according to one or more embodiments of the present invention will be described with reference to FIG. 1. In the following, "power window" will be referred to as "PW".

A PW control system 100 is provided on a vehicle and includes a PW control device 1, a remote control machine 2, and other components 3 to 9.

The PW control device 1 drives the motor 3 to operate the PW opening/closing mechanism 4, thereby carrying out an operation for opening/closing the window glass 6 of the window 5 provided on a door of the vehicle. The PW control device 1 is taken as an example of an "opening/closing body control device" according to one or more embodiments of the present invention. The window 5 and the window glass 6 are taken as an example of an "opening/closing body" according to one or more embodiments of the present invention.

The PW control device 1 includes a controller 11, a storage unit 12, a driving unit 14, a pulse detector 15, a PW operating unit 16, a receiver 17, an engine state detector 18 and a door state detector 19.

The controller 11 is configured by a microcomputer and controls to open/close the window 5. The controller 11 is provided with a load detector 11*a*, an insertion deciding unit 11*b* and a threshold changing unit 11*c*. The storage unit 12 is configured by a memory such as an ROM or an RAM.

The driving unit 14 is configured by a circuit for driving the motor 3 through normal or reverse rotation. The rotary encoder 7 outputs a pulse which is synchronous with the rotation of the motor 3. The pulse detector 15 is configured by a circuit for detecting a pulse output from the rotary encoder 7.

The PW operating unit 16 is configured by a switch for operating to open/close the window 5 and is provided in the vehicle. The PW operating unit 16 is operated by a user to output a signal corresponding to the operation. The controller 11 detects the operation state of the PW operating unit 16 based on the signal output from the PW operating unit 16. The PW operating unit 16 is taken as an example of an "operating unit" according to one or more embodiments of the present invention.

The receiver 17 is configured by a circuit for receiving a signal transmitted from the remote control machine 2. The receiver 17 is taken as an example of a "receiver" according to one or more embodiments of the present invention.

The IG-SW (ignition switch) 8 is operated by a driver to output an on or off signal. The engine state detector 18 detects that the engine is in a driving or stopping state based on the on/off signal output from the IG-SW 8. The engine state detector 18 is taken as an example of an "engine state detector" according to one or more embodiments of the present invention.

The door opening/closing sensor 9 is provided on each door and outputs an on or off signal depending on the opening/closing state of the door. The door state detector 19 detects the opening/closing state of each door based on the on/off signal output from the door opening/closing sensor 9. The door state detector 19 is taken as an example of a "door state detector" according to one or more embodiments of the present invention.

The remote control machine 2 is configured by an FOB key of a passive entry system or a high function mobile phone (such as a smart phone), for example and is carried by a user. The remote control machine 2 includes a controller 21, a PW operating unit 22 and a transmitter 23.

The controller 21 is configured by a microcomputer. The PW operating unit 22 is configured by a switch or key for operating the window 5 to be opened and closed. The transmitter 23 is configured by a circuit for transmitting a signal to the PW control device 1.

When the user carries out the opening/closing operation of the PW operating unit 22, the controller 21 generates an opening/closing command depending on the operation state. Then, the opening/closing command is transmitted by the transmitter 23 and is received by the receiver 17 of the PW control device 1. Consequently, the controller 11 of the PW control device 1 detects that the PW operating unit 22 of the remote control machine 2 is subjected to the opening/closing operation.

Moreover, the controller 11 controls the driving unit 14 to rotate the motor 3 normally or reversely depending on the opening/closing command sent from the remote control machine 2 and received by the receiver 17 or the opening/closing operation state of the PW operating unit 16. Consequently, the PW opening/closing mechanism 4 is operated so that the window glass 6 is moved downward or upward and the window 5 is opened or closed.

At that time, the controller 11 calculates a quantity of opening/closing movement of the window glass 6 or a rotating speed of the motor 3 based on a pulse detected by the pulse detector 15. Then, the controller 11 controls the rotation of the motor 3 by the driving unit 14 based on a result of the calculation. The load detector 11*a* detects the load of the motor 3 based on the rotating speed of the motor 3. The controller 11 is taken as an example of a "controller" according to one or more embodiments of the present invention. The load detector 11*a* is taken as an example of a "load detector".

When an operation for closing (moving upward) the window glass 6 is to be carried out depending on a closing command sent from the remote control machine 2 or the closing operation of the PW operating unit 16, the insertion deciding unit 11*b* calculates a variation in the load of the motor 3 which is detected by the load detector 11*a*. Then, the insertion deciding unit 11*b* compares the variation in the load of the motor 3 with a predetermined threshold, thereby deciding presence of insertion of a foreign substance into the window 5. The insertion deciding unit 11*b* is taken as an example of a "deciding unit" according to one or more embodiments of the present invention.

An insertion deciding threshold includes a normal value and a sensitive value, and they are stored in the storage unit 12.

The normal value is set to be such a value that the insertion of the foreign substance into the window 5 can be prevented from being erroneously detected by the insertion deciding unit 11*b* even if the load of the motor 3 is influenced by a shock in the closure of the door or a vibration caused by vehicle running or engine driving.

The sensitive value is set to be such a value as to detect the insertion of the foreign substance into the window 5 more sensitively than the normal value. More specifically, the sensitive value has a higher sensitivity for detecting the insertion than the normal value. In other words, the sensitive value detects the insertion with a smaller load of the motor 3 than the normal value.

The threshold changing unit 11*c* reads each value from the storage unit 12 and sets the value to the insertion deciding unit 11*b*, thereby changing the insertion deciding threshold. The threshold changing unit 11*c* is taken as an example of a "changing unit" according to one or more embodiments of the present invention.

Next, an operation of the PW control device 1 according to a first embodiment will be described with reference to FIG. 2. The present operation is carried out when the window 5 is to be closed.

First of all, the threshold changing unit 11*c* reads a normal value as an insertion deciding threshold from the storage unit 12 and sets the normal value to the insertion deciding unit 11*b* (Step S1). Next, it is detected whether the engine is in a stopping state or not (Step S2). If the IG-SW 8 is in an on state, the engine state detector 18 detects that the engine is not in the stopping state (is in a driving state) ('Step S2: NO). Then, the controller 11 decides whether an operation for closing the window 5 is carried out by the PW operating unit 16 in a vehicle or not (Step S4).

On the other hand, if the IG-SW 8 is in an off state, the engine state detector 18 detects that the engine is in the stopping state (Step S2: YES). Then, the controller 11 decides whether a command for closing the window 5 is received from the remote control machine 2 or not (Step S3). If the command for closing the window 5 is not received from the remote control machine 2 by the receiver 17 within a predetermined time (Step S3: NO), the controller 11 decides whether the operation for closing the window 5 is carried out by the PW operating unit 16 in the vehicle or not (Step S4).

When a user performs the closing operation of the PW operating unit 16 in the vehicle, the controller 11 decides that the operation for closing the window 5 is carried out by the PW operating unit 16 (Step S4: YES) and the driving unit 14 drives the motor 3 to execute the operation for closing the window glass 6 (Step S5).

During the operation for closing the window glass 6, the insertion deciding unit 11*b* compares a variation in a load of the motor 3 which is detected by the load detector 11*a* with a threshold (in this case, the "normal value") and thus decides the presence of the insertion of a foreign substance into the window 5 (Step S6).

If the variation in the load of the motor 3 is smaller than the threshold, the insertion deciding unit 11*b* decides that the insertion is not present (Step S6: NO).

In this case, the controller 11 decides whether a closing operation condition of an internal operation (the PW operating unit 16) is not satisfied (Step S7).

For example, when a manual closing operation of the PW operating unit 16 which is performed in the Step S4 is continuously executed till the Step S7 or when the PW operating unit 16 is not operated till the Step S7 after an automatic closing operation in the Step S4, the closing operation of the PW operating unit 16 is valid in the Step S7. In addition, if it is detected that the window glass 6 does not reach a full closing position based on a quantity of movement of the window glass 6, the controller 11 decides that the closing operation condition of the internal operation is satisfied (Step S7: NO).

If the closing operation condition of the internal operation is satisfied, thus, the operation for closing the window glass 6 is continuously carried out by the controller 11 and the decision of the insertion is made by the insertion deciding unit 11*b* again (Step S6).

On the other hand, for example, when the manual closing operation of the PW operating unit 16 which is carried out in the Step S4 is cancelled in the Step S7 or when the PW operating unit 16 performs the automatic closing operation in the Step S4 and then carries out the operation into another opening/closing operation state till the Step S7, the closing operation of the PW operating unit 16 is invalid in the Step S7. For this reason, the controller 11 decides that the closing operation condition of the internal operation is not satisfied (Step S7: YES). For example, also when the window glass 6 reaches the full closing position, the controller 11 decides that the closing operation condition of the internal operation is not satisfied (Step S7: YES).

If the closing operation condition of the internal operation is not satisfied, thus, the controller 11 stops the driving operation of the motor 3, thereby halting the operation for closing the window glass 6 (Step S8). Then, each processing is executed again from the Step S1.

If the variation in the load of the motor 3 is equal to or greater than the threshold during the operation for closing the window glass 6, moreover, the insertion deciding unit 11*b* decides that the insertion is present (Step S6: YES). In this case, the controller 11 stops the driving operation of the motor 3 to halt the operation for closing the window glass 6, then inverts the motor 3 and executes an operation for opening the window glass 6 in a predetermined quantity (Step S9). As another example, it is sufficient to stop the operation for closing the window glass 6. After the Step S9, each processing is executed again from the Step S1.

On the other hand, if the user performs the closing operation of the PW operating unit 22 of the remote control machine 2 in the engine stopping state (Step S2: YES), a command for closing the window 5 is transmitted from the remote control machine 2. Upon receipt of the command for closing the window 5 from the receiver 17 (Step S3: YES), the threshold changing unit 11*c* reads the sensitive value as the insertion deciding threshold from the storage unit 12 and sets the sensitive value to the insertion deciding unit 11*b* (Step S10).

Then, the controller 11 drives the motor 3 by means of the driving unit 14, thereby executing the operation for closing the window glass 6 (Step S11). Moreover, the insertion deciding unit 11*b* compares the variation in the load of the motor 3 which is detected by the load detector 11*a* with the threshold (in this case, the "sensitive value") and decides the presence of the insertion of a foreign substance into the window 5 (Step S12).

If the variation in the load of the motor 3 is smaller than the threshold, the insertion deciding unit 11*b* decides that the insertion is not present (Step S12: NO). In this case, the controller 11 decides whether the closing operation condition of the remote control (the remote control machine 2) is not satisfied (Step S13).

For example, if the PW operating unit 22 of the remote control machine 2 is caused to perform the manual closing operation and the command for closing the window 5 is received continuously or intermittently from the remote control machine 2 by the receiver 17 from the Step S3 to the Step S13, the closing command of the remote control machine 2 is valid in the Step S13. For example, also when the PW operating unit 22 is caused to perform the automatic closing operation so that the command for closing the window 5 is received from the remote control machine 2 by the receiver 17 in the Step S3 and another opening/closing command is not received from the remote control machine 2 till the Step S13, the closing command of the remote control machine 2 is valid in the Step S13.

If the closing command of the remote control machine 2 is valid, and furthermore, the engine state detector 18 detects that the engine is in the stopping state and it is detected that the window glass 6 does not reach the full closing position, thus, the controller 11 decides that the closing operation condition of the remote control is satisfied (Step S13: NO). Then, the operation for closing the window glass 6 is continuously carried out by the controller 11 and the decision of the insertion is made again by the insertion deciding unit 11*b* (Step S12).

On the other hand, if the PW operating unit 22 of the remote control machine 2 is caused to perform the manual closing operation so that the command for closing the window 5 is received from the remote control machine 2 in the Step S3, and then, the closing command is not received continuously or intermittently by the receiver 17 till the Step S13, for example, the closing command of the remote control machine 2 is invalid in the Step S13.

For example, also when the PW operating unit 22 is caused to perform the automatic closing operation so that the command for closing the window 5 is received from the remote control machine 2 by the receiver 17 in the Step S3 and another opening/closing command is then received from the remote control machine 2 till the Step S13, the closing command of the remote control machine 2 is invalid in the Step S13.

If the closing command of the remote control machine 2 is invalid, thus, the controller 11 decides that the closing operation condition of the remote control is not satisfied (Step S13: YES).

For example, also when the engine state detector 18 detects that the engine is in the driving state or when it is detected that the window glass 6 reaches the full closing position, the controller 11 decides that the closing operation condition of the remote control is not satisfied (Step S13: YES).

If the closing operation condition of the remote control is not satisfied, thus, the controller 11 stops the driving operation of the motor 3, thereby halting the operation for closing the window glass 6 (Step S14). Thereafter, each processing is executed again from the Step S1.

On other hand, if the variation in the load of the motor 3 is equal to or greater than the threshold in the Step S12, the insertion deciding unit 11*b* decides that the insertion is present (Step S12: YES). In this case, the controller 11 stops the driving operation of the motor 3 to halt the operation for closing the window glass 6, and then inverts the motor 3 to execute the operation for opening the window glass 6 in a predetermined quantity (Step S15). As another example, it is sufficient to stop the operation for closing the window glass 6 or to carry out an operation for opening the window glass 6 to a full opening position.

If the operation for opening/closing the window 5 is then carried out within a predetermined time by the PW operating unit 16 in the vehicle or the PW operating unit 22 of the remote control machine 2 (Step S16: YES), the processing returns to the Step S1 and each processing is executed. Alternatively, the operation for opening/closing the window glass 6 is carried out depending on the operation state of the PW operating units 16 and 22.

On the other hand, if the opening/closing operation is not carried out by the PW operating units 22 and 16 after the Step S15 but a predetermined time passes (Step S16: NO), the controller 11 automatically drives the motor 3 and executes the operation for closing the window glass 6 (Step S17). Moreover, the insertion deciding unit 11*b* compares the variation in the load of the motor 3 which is detected by the load detector 11*a* with the threshold and decides the presence of the insertion of a foreign substance into the window 5 (Step S18).

If it is decided that the insertion is present by the insertion deciding unit 11*b* (Step S18: YES), subsequently, the controller 11 controls the motor 3 to stop the operation for closing the window glass 6, and then executes the operation for opening the window glass 6 in a predetermined quantity (Step S19). Thereafter, each processing is executed again from the Step S1.

If it is decided that the insertion is not present by the insertion deciding unit 11*b* (Step S18: NO), the controller 11 decides whether the closing operation condition of the remote control is not satisfied (Step S20).

At this time, if the opening/closing operation is not carried out by the PW operating units 22 and 16 but the engine is in the stopping state and the window glass 6 does not reach the full closing position, for example, the controller 11 decides that the closing operation condition of the remote control is satisfied (Step S20: NO). In this case, the operation for closing the window glass 6 is continuously carried out so that the decision of the insertion is made again by the insertion deciding unit 11*b* (Step S18).

In contrast, if the opening/closing operation is carried out by any of the PW operating units 22 and 16, the engine is brought into the driving state or the window glass 6 reaches the full closing position, for example, the controller 11 decides that the closing operation condition of the remote control is not satisfied (Step S20: YES). In this case, the driving operation of the motor 3 is stopped so that the operation for closing the window glass 6 is halted (Step S21). Subsequently, each processing is executed again from the Step S1.

According to the first embodiment, in the case in which the operation for closing the window glass 6 of the window 5 is carried out in accordance with the closing command sent from the remote control machine 2 in a state in which the engine of the vehicle is stopped, the insertion deciding threshold is changed from the normal value to the sensitive value (Step S10). For this reason, even if a foreign substance is inserted into the window 5, it is possible to quickly detect the insertion by comparing the variation in the load of the motor 3 with the sensitive value. In other words, smaller force than usual is applied to the motor 3 due to the insertion of the foreign substance into the window 5 so that the insertion can be detected. In the case in which the operation for closing the window glass 6 of the power window is carried out by the remote control, accordingly, it is possible to enhance detection precision in the insertion of the foreign substance into the window 5.

In the stoppage of the engine, moreover, the vehicle is in a parking state. For this reason, disturbance such as a vibration caused by running or engine driving can be prevented from acting. Even if the insertion deciding threshold is changed into the sensitive value with the engine in the stopping state, therefore, it is possible to detect the insertion with high precision without erroneously detecting the insertion due to the disturbance such as the vibration caused by the running or the engine driving.

When the insertion is detected during the operation for closing the window glass 6 by the remote control and the window glass 6 is once stopped and is then caused to carry out the opening operation, and thereafter, the PW operating unit 16 in the vehicle or the PW operating unit 22 of the remote control machine 2 does not carry out the opening/closing operation but a predetermined time passes, the window glass 6 is caused to automatically carry out the closing operation (Step S17). For this reason, even if the user does not notice that the window 5 cannot be closed completely by the remote control, it is possible to prevent the window 5 from being left in an opening state.

Furthermore, the variation in the load of the motor 3 is compared with the threshold to decide the presence of the insertion also while the window glass 6 is caused to automatically carry out the closing operation (Step S18). Even if the foreign substance is inserted into the window 5, therefore, it is possible to reliably detect the insertion.

Figure 3:
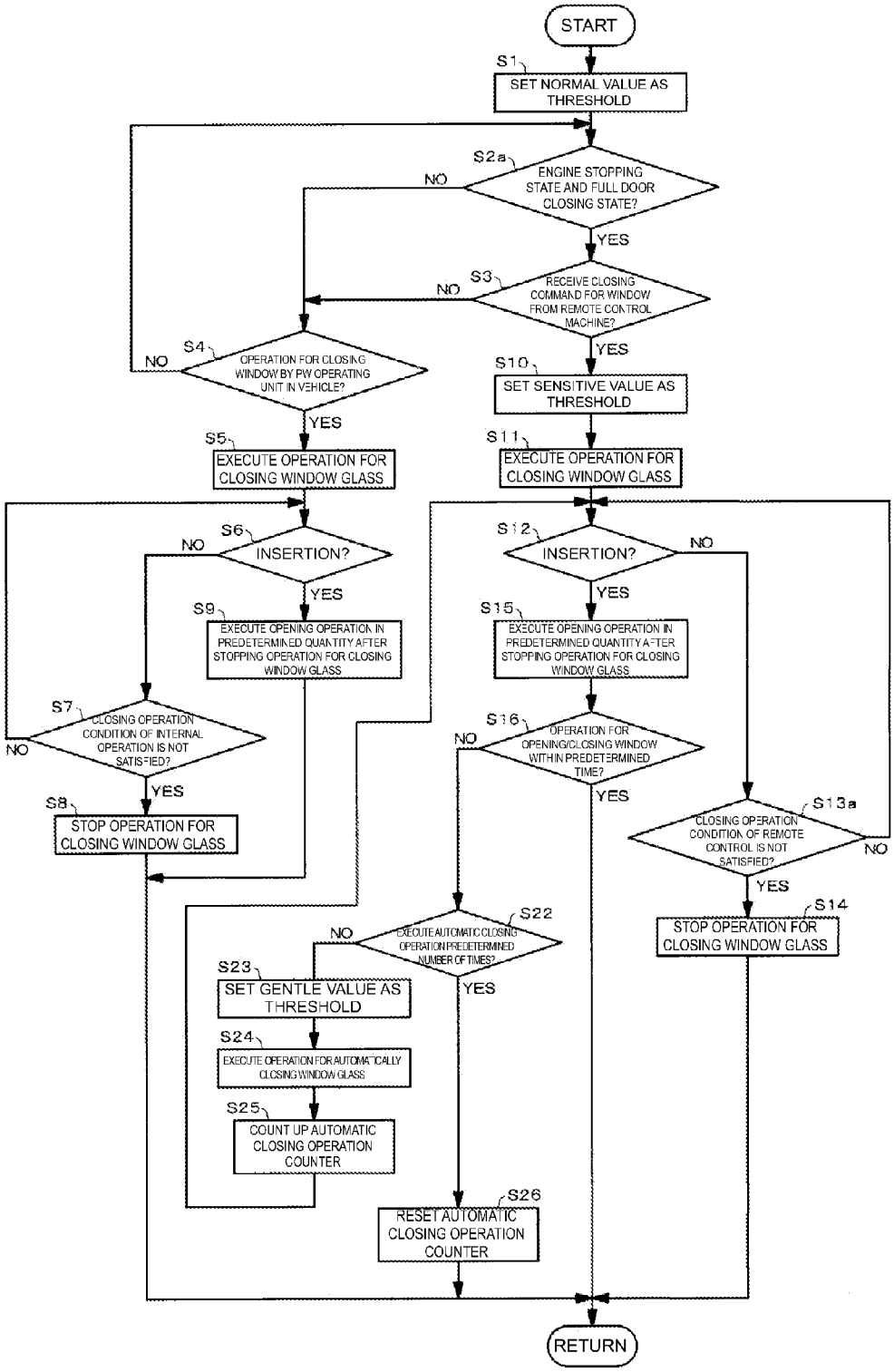
FIG. 3 is a flow chart showing an operation of a power window control device according to a second embodiment.

Next, an operation of the PW control device 1 according to a second embodiment will be described with reference to FIG. 3. The present operation is also the same as the operation to be carried out in the closure of the window 5.

After the threshold changing unit 11*c* sets the normal value as the insertion deciding threshold (Step S1), the controller 11 confirms the state of the engine and that of each door. If it is detected that the engine is not in the stopping state by the IG-SW 8 and the engine state detector 18 or it is detected that any of the doors is not in the closing state by the door opening/closing sensor 9 and the door state detector 19 (Step S2*a*: NO), the controller 11 decides whether the operation for closing the window 5 is carried out by the PW operating unit 16 in the vehicle or not (Step S4).

On the other hand, if it is detected that the engine is in the stopping state and all of the doors are in the closing state (Step S2*a*: YES), the controller 11 decides whether a command for closing the window 5 is received from the remote control machine 2 or not (Step S3). If the command for closing the window 5 is received from the remote control machine 2 by the receiver 17 (Step S3: YES), the threshold changing unit 11*c* sets a sensitive value as the insertion deciding threshold (Step S10).

Then, the controller 11 drives the motor 3 to execute the operation for closing the window glass 6 (Step S11). Moreover, the insertion deciding unit 11*b* compares the variation in the load of the motor 3 with the threshold and decides the presence of the insertion of a foreign substance into the window 5 (Step S12).

If it is decided that the insertion is not present by the insertion deciding unit 11*b* (Step S12: NO), then, the controller 11 decides whether the closing operation condition of the remote control is not satisfied (Step S13*a*). The closing operation condition of the remote control in this case includes that the closing command of the remote control machine 2 is valid, the engine is in the stopping state, the window glass 6 does not reach the full closing position, and furthermore, all of the doors are in the closing state.

For this reason, if the closing command of the remote control machine 2 is valid, the engine is in the stopping state, the window glass 6 does not reach the full closing position and all of the doors are in the closing state, the controller 11 decides that the closing operation condition of the remote control is satisfied (Step S13*a*: NO). Then, the operation for closing the window glass 6 is continuously carried out by the controller 11 and the insertion is decided again by the insertion deciding unit 11*b* (Step S12).

On the other hand, if the closing command of the remote control machine 2 is invalid, the engine is in the driving state, the window glass 6 reaches the full closing position or any of the doors is in the closing state, the controller 11 decides that the closing operation condition of the remote control is not satisfied (Step S13*a*: YES). Then, the controller 11 stops the driving operation of the motor 3, thereby halting the operation for closing the window glass 6 (Step S14). Thereafter, each processing is executed again from the Step S1.

If the insertion deciding unit 11*b* decides that the insertion is present in the Step S12 (Step S12: YES), the controller 11 controls the motor 3 to stop the operation for closing the window glass 6 and then executes the operation for opening the window glass 6 in a predetermined quantity (Step S15).

Thereafter, the opening/closing operation is not carried out by the PW operating unit 16 in the vehicle or the PW operating unit 22 of the remote control machine 2 but a predetermined time passes (Step S16: NO). Consequently, the controller 11 decides whether the operation for automatically closing the window glass 6 (processing of Step S24 which will be described below) is executed a predetermined number of times or not by referring to an automatic closing operation counter provided in the storage unit 12, for example (Step S22).

If the controller 11 decides that the operation for automatically closing the window glass 6 is not executed the predetermined number of times (Step S22: NO), the threshold changing unit 11*c* reads a gentler value than the sensitive value as the insertion deciding threshold from the storage unit 12 and sets the same value to the insertion deciding unit 11*b* (Step S23). The gentle value may be an intermediate value between the normal value and the sensitive value, may be equal to the normal value or may be a value for detecting the insertion of the foreign substance into the window 5 more insensitively than the normal value.

If the insertion deciding threshold is changed, the controller 11 automatically drives the motor 3 to execute the operation for closing the window glass 6 (Step S24). Moreover, the controller 11 counts up the automatic closing operation counter provided in the storage unit 12 by one, for example (Step S25).

Then, the insertion deciding unit 11*b* compares the variation in the load of the motor 3 which is detected by the load detector 11*a* with the threshold (in this case, the "gentle value") and decides the presence of the insertion of the foreign substance into the window 5 again (Step S12).

When each processing is repeated a predetermined number of times in order of the Steps S12, S15 to S17 and S22 to S25, thereafter, the controller 11 decides that the operation for automatically closing the window glass 6 is executed the predetermined number of times by referring to the automatic closing operation counter in next Step S22 (Step S22: YES). Subsequently, the controller 11 resets (initializes) the automatic closing operation counter (Step S26). Then, each processing is executed again from the Step S1.

According to the second embodiment, when the window glass 6 is caused to carry out the closing operation by the remote control in the stopping state of the engine and the closing state of all of the doors, the insertion deciding threshold is changed from the normal value to the sensitive value (Step S10). Therefore, it is possible to quickly detect the insertion of the foreign substance into the window 5, thereby enhancing detection precision in the insertion.

Since all of the doors are in the closing state, moreover, disturbance such as a shock in the closure of the door does not act. For this reason, even if the insertion deciding threshold is changed into the sensitive value in the closing state of all of the doors, it is possible to detect the insertion with high precision without detecting the insertion erroneously due to the disturbance such as the shock in the closure of the door.

If the insertion is detected during the operation for closing the window glass 6 by the remote control, the window glass 6 is stopped and is then subjected to the opening operation and the opening/closing operation is not performed by the PW operating unit 16 in the vehicle or the PW operating unit 22 of the remote control machine 2 but a predetermined time passes, the processing for automatically closing the window glass 6 (Step S24) is repeated a predetermined number of times (Step S22). Therefore, it is possible to prevent the window 5 from being left in the opening state.

When the operation for automatically closing the window glass 6 is to be carried out, the insertion deciding threshold is changed into a gentler value than the sensitive value (Step S23). For this reason, it is harder to decide that the insertion is present and it is easier to completely close the window 5 as compared with the case in which the operation for closing the window glass 6 is carried out by the remote control.

Furthermore, the number of times that the operation for automatically closing the window glass 6 is carried out is restricted to be the predetermined number of times. Therefore, it is possible to reduce power consumption during the engine stoppage to some degree, thereby preventing a battery from going flat.

Figure 4:
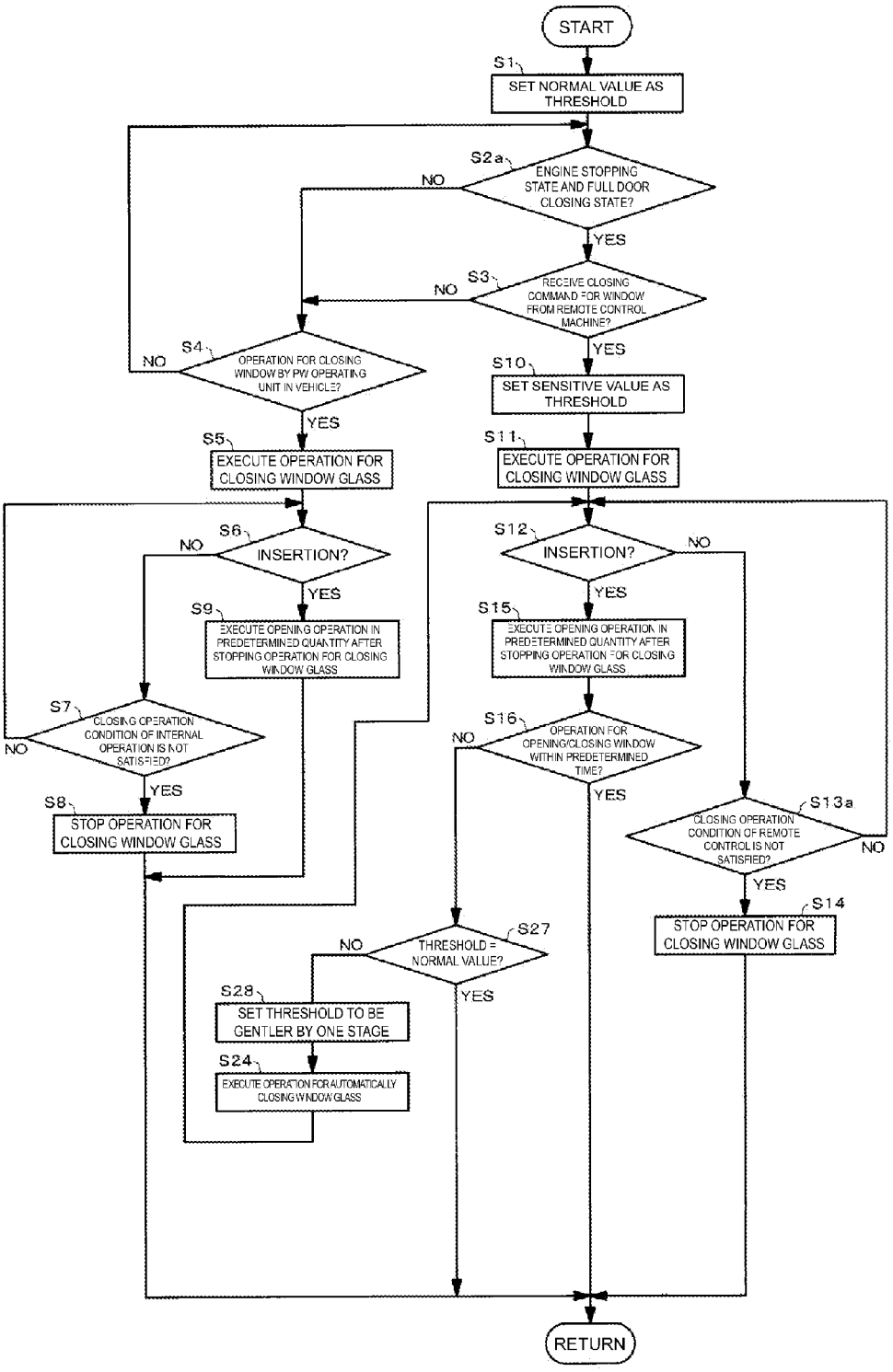
FIG. 4 is a flow chart showing an operation of a power window control device according to a third embodiment.

Next, an operation of the PW control device 1 according to a third embodiment will be described with reference to FIG. 4. The present operation is also the same as the operation to be carried out in the closure of the window 5.

As described above, if the Steps S1 to S11 are executed and it is then decided that the insertion is present (Step S12: YES), the operation for closing the window glass 6 is stopped and the operation for opening the window glass 6 is then executed in a predetermined quantity (Step S15).

If the opening/closing operation of the PW operating units 22 and 16 is not carried out but a predetermined time passes (Step S16: NO), thereafter, the controller 11 decides whether the insertion deciding threshold set to the insertion deciding unit 11*b* is equal to the normal value or not (Step S27). If the insertion deciding threshold is a value other than the normal value (Step S27: NO), the threshold changing unit 11*c* relaxes the insertion deciding threshold by one stage from a current value and sets a value thus obtained to the insertion deciding unit 11*b* (Step S28).

More specifically, for example, each value obtained by stepwise relaxation to reach the normal value from the sensitive value is prestored as the insertion deciding threshold in the storage unit 12. Then, the threshold changing unit 11*c* reads a next gentle value to the current value from the storage unit 12 and sets the same value to the insertion deciding unit 11*b* in the Step S28. As another example, in the Step S28, the threshold changing unit 11*c* may calculate a gentler value than the current value by one stage through addition of a predetermined value to the current value or the like.

When the insertion deciding threshold is changed, the controller 11 automatically drives the motor 3 to execute the operation for closing the window glass 6 (Step S24). Then, the variation in the load of the motor 3 is compared with the changed threshold so that the presence of the insertion is decided (Step S12).

Through the Steps S12 to S15 and S16, if the insertion deciding threshold is not equal to the normal value in the Step S27 again (Step S27: NO), the threshold changing unit 11*c* reads the gentler value than the current value by one stage from the storage unit 12 and sets the same value to the insertion deciding unit 11*b* (Step S28). Then, the operation for automatically closing the window glass 6 is executed again (Step S24) and the presence of the insertion is decided (Step S12).

Thereafter, each processing is repeated a predetermined number of times in order of the Steps S12, S15, S16, S27, S28 and S24. If the insertion deciding threshold is equal to the normal value (Step S27: YES), each processing is executed again from the Step S1.

According to the third embodiment, when the window glass 6 is caused to carry out the closing operation by the remote control in the stopping state of the engine and the closing state of all of the doors, the insertion deciding threshold is changed to the sensitive value (Step S10). Therefore, it is possible to quickly detect the insertion, thereby enhancing the detection precision. If the insertion is detected and the window glass 6 is subjected to the opening operation, and then, the opening/closing operation is not performed by the PW operating units 16 and 22 but a predetermined time passes, the operation for automatically closing the window glass 6 is carried out (Step S24). Consequently, it is possible to prevent the window 5 from being left in the opening state.

Every time the operation for automatically closing the window glass 6 is carried out, the insertion deciding threshold is changed to be stepwise gentler from the sensitive value to the normal value (Step S28). For this reason, it is hard to decide that the insertion is present and it is easy to completely close the window 5. When it is confirmed that the changed insertion deciding threshold is equal to the normal value, furthermore, the operation for automatically closing the window glass 6 is stopped (Step S27). Therefore, it is possible to restrict the number of times that the automatic closing operation is executed, thereby preventing a battery from going flat.

The present invention can employ various embodiments in addition to the above. For example, although the example in which the insertion deciding threshold is changed and the operation for closing the window glass 6 is then executed has been described in the embodiments shown in FIGS. 3 and 4, the present invention is not restricted thereto. In addition, it is also possible to change the insertion deciding threshold simultaneously with or after the start of the operation for closing the window glass 6, for example.

Figure 2:
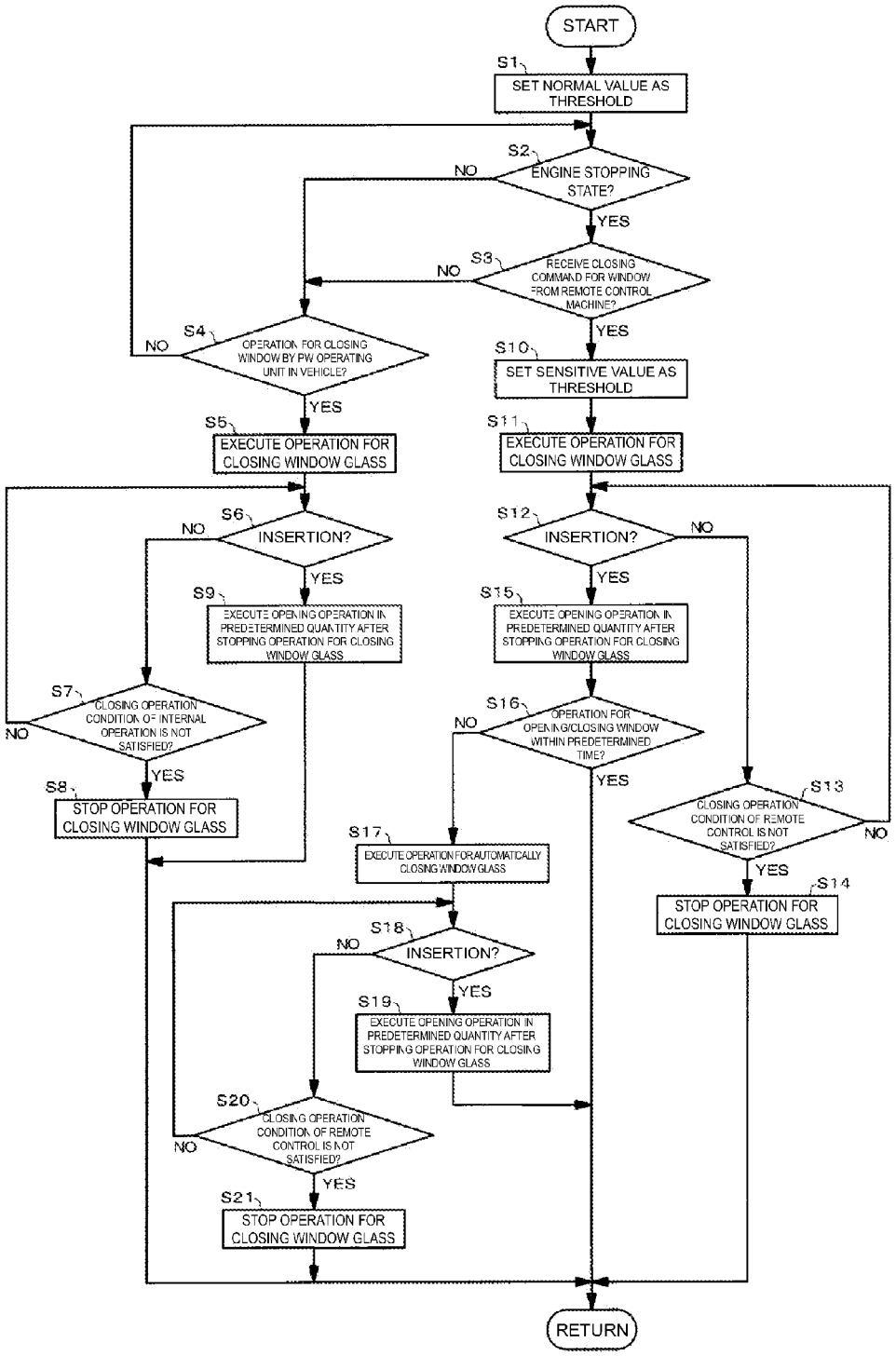
FIG. 2 is a flow chart showing an operation of a power window control device according to a first embodiment.

Although the receipt of the closing command from the remote control machine 2 in the engine stopping state is set to be the condition for changing the threshold to the sensitive value in the embodiment of FIG. 2, moreover, the present invention is not restricted thereto. As shown in FIGS. 3 and 4, the receipt of the closing command from the remote control machine 2 in the engine stopping state and the full door closing state may be set to be the condition for changing the threshold to the sensitive value in the embodiment of FIG. 2. To the contrary, as shown in FIG. 2, the receipt of the closing command from the remote control machine 2 in the engine stopping state may be set to be the condition for changing the threshold to the sensitive value in the embodiments of FIGS. 3 and 4.

Although the example in which the engine driving/stopping state is detected based on the on/off state of the IG-SW 8 has been described in the above embodiments, moreover, the present invention is not restricted thereto. In addition, for example, the engine driving/stopping state may be detected based on a signal output from a sensor for detecting a vibration caused by engine driving, a signal output from an ECU (electronic control unit) for controlling the engine driving and stoppage or the like.

Although the example in which the closing state of the door is detected based on a signal output from the door opening/closing sensor 9 has been described in the above embodiments, furthermore, the present invention is not restricted thereto. In addition, for example, it is also possible to decide that the door is in the closing state if it is detected that the door is in a locking state based on a signal output from a door lock detecting sensor or switch, an ECU or the like.

Although the example in which the load of the motor 3 is detected based on the rotating speed of the motor 3 has been described in the above embodiments, moreover, the present invention is not restricted thereto. In addition, for example, it is also possible to detect the number of rotations or rotating speed of the motor 3 and to detect the load of the motor 3 therefrom based on current flowing to the motor 3. In that case, it is possible to omit the rotary encoder 7 and the pulse detector 15.

Although the example in which one or more embodiments of the present invention is applied to the PW (Power Window) control device 1 for a vehicle has been taken in the above embodiments, furthermore, the present invention is not restricted thereto. In addition, one or more embodiments of the present invention can also be applied to an opening/closing body control device for controlling an opening/closing operation of an opening/closing body of a vehicle, for example, an electric opening/closing roof or the like.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An opening/closing body control device comprising:

a controller that controls a driving operation of a motor for carrying out an operation for opening/closing an opening/closing body of a vehicle;

a load detector that detects a load of the motor;

a deciding part that compares a variation in the load detected by the load detector with a predetermined threshold, thereby deciding presence of insertion of a foreign substance into the opening/closing body during the operation for closing the opening/closing body;

an engine state detector that detects a stopping state of an engine of the vehicle;

a receiver that receives a closing command for the opening/closing body which is transmitted from a remote control machine; and a changing part that changes the threshold, wherein, when the stopping state of the engine is detected by the engine state detector and the closing command is received by the receiver:

the changing part changes the threshold from a normal value to a sensitive value for detecting the insertion more sensitivity than the normal value, the controller controls the motor to carry out the operation for closing the opening/closing body, the controller controls the motor and stops the opening/closing body or carries out the opening operation after the stoppage if the deciding part decides that the insertion is present during the operation for closing the opening/closing body, and the controller automatically controls the motor to carry out the operation for closing the opening/closing body if a predetermined time then passes.

2. The opening/closing body control device according to claim 1, wherein, while the controller automatically controls the motor to carry out the operation for closing the opening/closing body, the deciding part decides the presence of the insertion.

3. The opening/closing body control device according to claim 2, wherein, when the controller automatically controls the motor to carry out the operation for closing the opening/closing body, the changing part changes the threshold to a gentler value than the sensitive value.

4. The opening/closing body control device according to claim 3, wherein the controller automatically controls the motor to restrict, to a predetermined number of times, a number of times that the operation for closing the opening/closing body is carried out.

5. The opening/closing body control device according to claim 4, wherein, every time the controller automatically controls the motor to carry out the operation for closing the opening/closing body, the changing part changes the threshold to become stepwise gentler.

6. The opening/closing body control device according to claim 3, wherein, every time the controller automatically controls the motor to carry out the operation for closing the opening/closing body, the changing part changes the threshold to become stepwise gentler.

7. The opening/closing body control device according to claim 3, further comprising:

a door state detector that detects an opening/closing state of a door of a vehicle, wherein, when the stopping state of the engine is detected by the engine state detector and the closing command for the opening/closing body is received by the receiver, and the closing states of all of the doors are detected by the door state detector:

the changing part changes the threshold from the normal value to the sensitive value, and the controller controls the motor to carry out the operation for closing the opening/closing body.

8. The opening/closing body control device according to claim 3, wherein the opening/closing body comprises a power window provided on the door and a window glass, wherein an operating part is further provided in the vehicle, and wherein the controller drives the motor to carry out an operation for opening/closing the window glass depending on a command sent from the remote control machine or an operation state of the operating part.

9. The opening/closing body control device according to claim 2, wherein the controller automatically controls the motor to restrict, to a predetermined number of times, a number of times that the operation for closing the opening/closing body is carried out.

10. The opening/closing body control device according to claim 9, wherein, every time the controller automatically controls the motor to carry out the operation for closing the opening/closing body, the changing part changes the threshold to become stepwise gentler.

11. The opening/closing body control device according to claim 9, further comprising:

a door state detector that detects an opening/closing state of a door of a vehicle, wherein, when the stopping state of the engine is detected by the engine state detector and the closing command for the opening/closing body is received by the receiver, and the closing states of all of the doors are detected by the door state detector:

the changing part changes the threshold from the normal value to the sensitive value, and the controller controls the motor to carry out the operation for closing the opening/closing body.

12. The opening/closing body control device according to claim 9, wherein the opening/closing body comprises a power window provided on the door and a window glass, wherein an operating part is further provided in the vehicle, and wherein the controller drives the motor to carry out an operation for opening/closing the window glass depending on a command sent from the remote control machine or an operation state of the operating part.

13. The opening/closing body control device according to claim 2, wherein, every time the controller automatically controls the motor to carry out the operation for closing the opening/closing body, the changing part changes the threshold to become stepwise gentler.

14. The opening/closing body control device according to claim 13, wherein the changing part changes the threshold from the sensitive value to the normal value so as to become stepwise gentler.

15. The opening/closing body control device according to claim 14, further comprising:

a door state detector that detects an opening/closing state of a door of a vehicle, wherein, when the stopping state of the engine is detected by the engine state detector and the closing command for the opening/closing body is received by the receiver, and the closing states of all of the doors are detected by the door state detector:

the changing part changes the threshold from the normal value to the sensitive value, and the controller controls the motor to carry out the operation for closing the opening/closing body.

16. The opening/closing body control device according to claim 13, further comprising:

a door state detector that detects an opening/closing state of a door of a vehicle, wherein, when the stopping state of the engine is detected by the engine state detector and the closing command for the opening/closing body is received by the receiver, and the closing states of all of the doors are detected by the door state detector:

the changing part changes the threshold from the normal value to the sensitive value, and the controller controls the motor to carry out the operation for closing the opening/closing body.

17. The opening/closing body control device according to claim 2, further comprising:

a door state detector that detects an opening/closing state of a door of a vehicle, wherein, when the stopping state of the engine is detected by the engine state detector and the closing command for the opening/closing body is received by the receiver, and the closing states of all of the doors are detected by the door state detector:

the changing part changes the threshold from the normal value to the sensitive value, and the controller controls the motor to carry out the operation for closing the opening/closing body.

18. The opening/closing body control device according to claim 2, wherein the opening/closing body comprises a power window provided on the door and a window glass, wherein an operating part is further provided in the vehicle, and wherein the controller drives the motor to carry out an operation for opening/closing the window glass depending on a command sent from the remote control machine or an operation state of the operating part.

19. The opening/closing body control device according to claim 1, further comprising:

a door state detector that detects an opening/closing state of a door of a vehicle, wherein, when the stopping state of the engine is detected by the engine state detector and the closing command for the opening/closing body is received by the receiver, and the closing states of all of the doors are detected by the door state detector:

the changing part changes the threshold from the normal value to the sensitive value, and the controller controls the motor to carry out the operation for closing the opening/closing body.

20. The opening/closing body control device according to claim 1, wherein the opening/closing body comprises a power window provided on the door and a window glass, wherein an operating part is further provided in the vehicle, and wherein the controller drives the motor to carry out an operation for opening/closing the window glass depending on a command sent from the remote control machine or an operation state of the operating part.

* * * * *